United States Patent [19]

Karls et al.

[11] Patent Number: 4,752,257

[45] Date of Patent: Jun. 21, 1988

[54] COOLING WATER INTAKE WITH INCREASED FLOW

[75] Inventors: Michael A. Karls, Hilbert; William P. Lang, Oshkosh, both of Wis.

[73] Assignee: Brunswick Corporation, Skokie, Ill.

[21] Appl. No.: 943,612

[22] Filed: Dec. 18, 1986

[51] Int. Cl.[4] ..... B63H 21/26

[52] U.S. Cl. ..... 440/76; 440/88

[58] Field of Search ..... 440/88, 89, 76, 78, 440/900; 123/41.01, 195 P

[56] References Cited

U.S. PATENT DOCUMENTS

| | | | |
|---|---|---|---|
| 3,066,639 | 12/1962 | Kiekhaefer | 440/88 |
| 4,392,779 | 7/1983 | Bloemers | 415/141 |
| 4,565,533 | 1/1986 | Springer | 440/71 |

FOREIGN PATENT DOCUMENTS

| | | | |
|---|---|---|---|
| 57-30691 | 2/1982 | Japan | 440/88 |

*Primary Examiner*—Sherman D. Basinger

*Attorney, Agent, or Firm*—Andrus, Sceales, Starke & Sawall

[57] ABSTRACT

A marine propulsion system (10) with a depending gear case (20) having water inlet openings (32 and 34) is provided with water intake plates (62 and 64) covering the water inlet openings (32 and 34) and having outer forward lips (66 and 68) spaced forwardly and outwardly of the water inlet openings (32 and 34) and outwardly of tapered gear case sections (36 and 38) leading to such openings. The water intake plates (62 and 64) define with the gear case (20) entrance cavities (70 and 72) around the water inlet openings (32 and 34), trapping additional water and directing same inwardly into the water inlet openings (32 and 34) for increasing water flow to a transverse passage (30) and to the water pump (16).

6 Claims, 3 Drawing Sheets

COOLING WATER INTAKE WITH INCREASED FLOW

BACKGROUND AND SUMMARY

The invention relates to water inlets in a marine propulsion gear case for supplying cooling water to the water pump for cooling the engine.

Conventional gear case water inlets are provided by holes in the gear case through which water is supplied to the water pump. In some applications, conventional water inlets are not capable of supplying sufficient pressure and water flow due to frothy or aerated water, typically due to obstructions on the bottom of the boat or to engine installation where the unit is mounted high on the transom, ventilating from the surface.

The present invention provides water intake means covering the conventional gear case water inlets and affording a much more aggressive water pickup. The water intake means in accordance with the invention provides positive water pressure and increased flow to the water pump, while having little affect on boat speed. The water intake has a forward opening edge for increasing water pickup, and a rearward trailing section holding the water captive around the normal inlets, forcing the water into the conventional gear case holes and to the water pump. The water intake of the invention can be mounted on gear cases with conventional cast-in water inlets or with conventional molded plastic inserts.

In one racing implementation, conventional inlets provided about 7 gallons per minute at 10 psi, at wide open throttle which corresponded to about 56 miles per hour. The water intake means in accordance with the invention provided 20 gallons per minute at 24 psi, at the same throttle and speed.

The invention has also been found to provide an additional advantage of enabling the motor to be raised by an inch and still be supplied with enough cooling water even though the water inlets are raised higher in the water. This one inch raising of the motor is desirable because it enables increased boat speed.

BRIEF DESCRIPTION OF THE DRAWINGS

Prior Art

Present Invention

Figure 6:
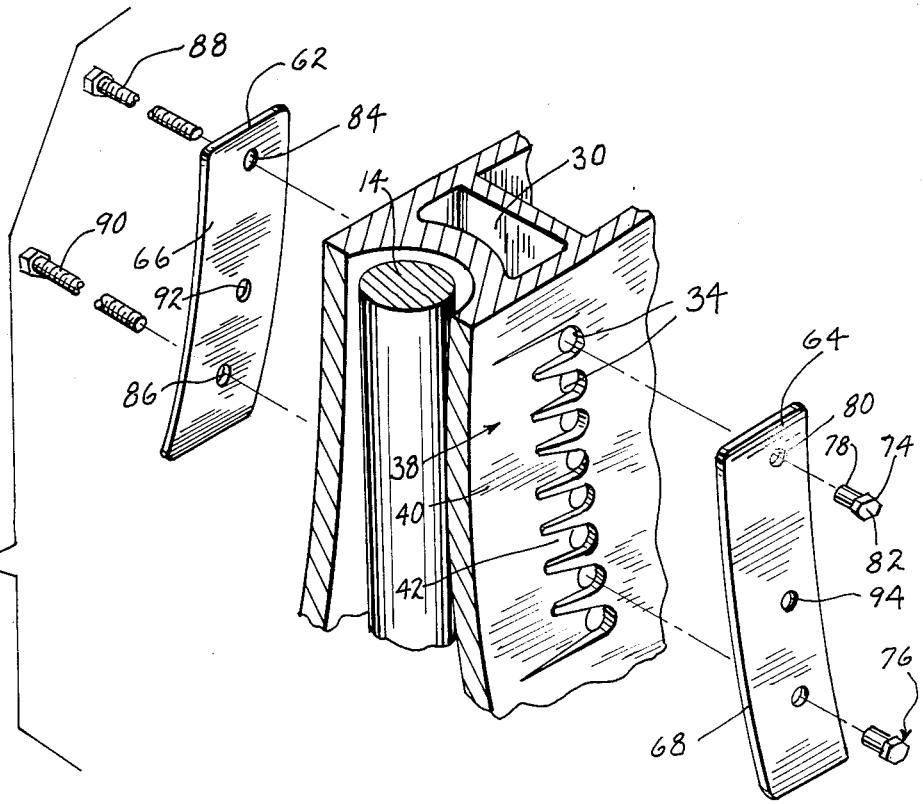

FIG. 6 is an exploded perspective view of water intake means in accordance with the invention.

Figure 7:
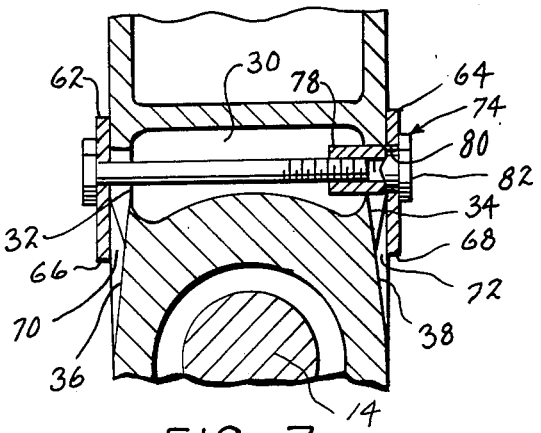
Figure 8:
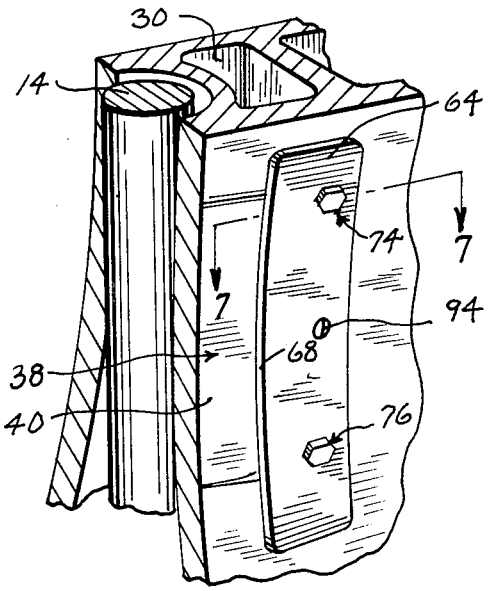

FIG. 7 is a sectional view taken along line 7—7 of FIG. 8.

FIG. 8 is a perspective assembly view of the structure in FIG. 6.

Figure 9:
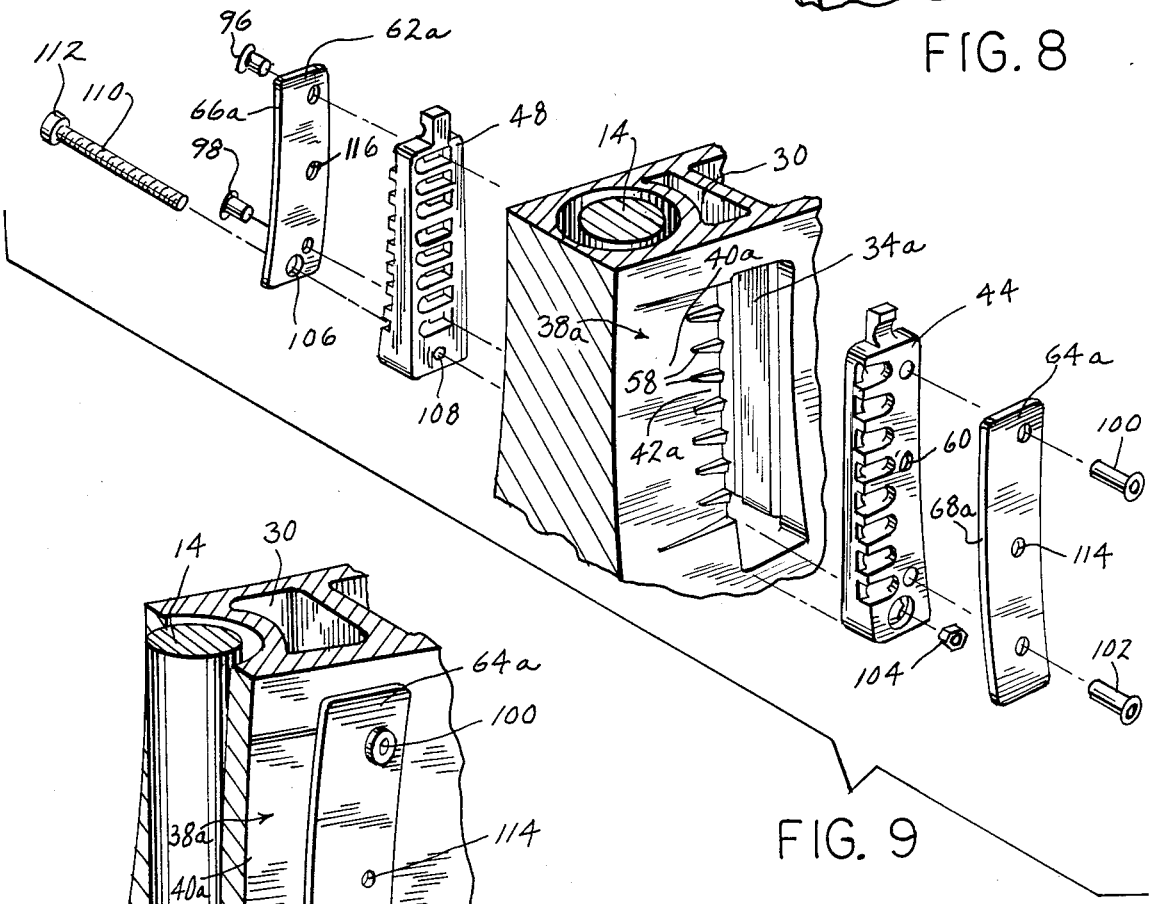

FIG. 9 is an exploded perspective view of an alternate embodiment of water intake means in accordance with the invention.

Figure 10:
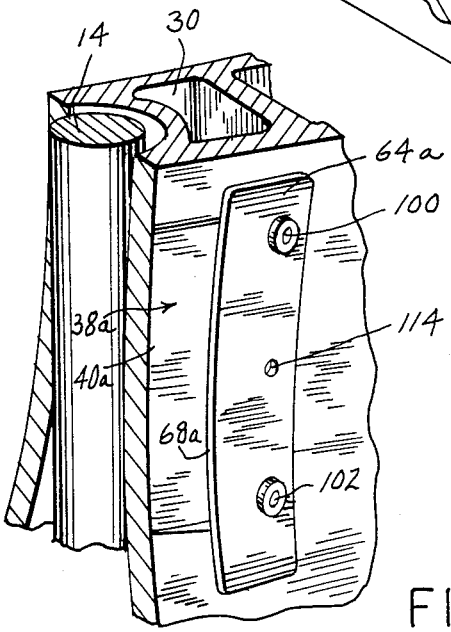

FIG. 10 is a perspective assembly view of the structure of FIG. 9.

DETAILED DESCRIPTION

Description of Prior Art

Figure 1:
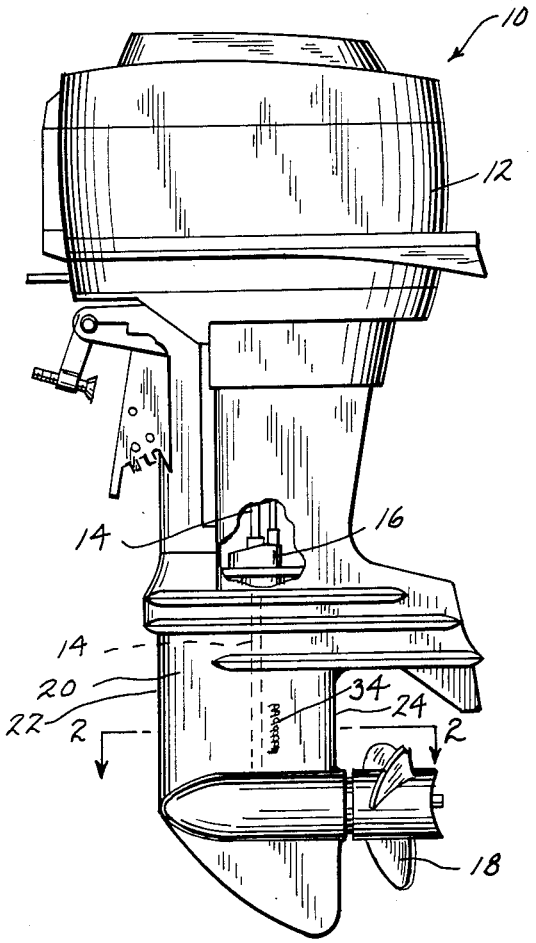
FIG. 1 PRIOR ART
FIG. 1 is a partially broken away side view of an outboard marine engine and depending gear case showing placement of water inlets.

FIG. 1 shows a marine propulsion system including an outboard engine 10, similarly to FIG. 1 of U.S. Pat. No. 4,392,779, incorporated herein by reference. Outboard engine 10 includes a liquid cooled power head 12 that powers drive shaft 14 and is cooled by water supplied by pump 16. Rotation of drive shaft 14 drives propeller 18 and also drives water pump 16, all as is well known.

Figure 2:
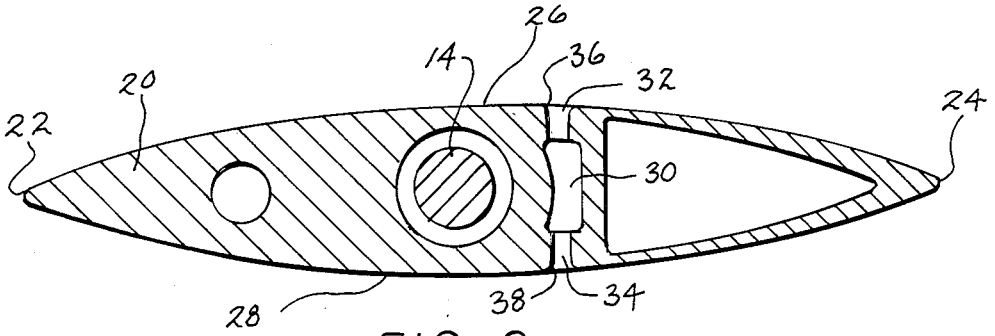
FIG. 2 PRIOR ART
FIG. 2 is an enlarged partial sectional view taken along line 2—2 of FIG. 1.

The outboard engine has a depending gear case 20 with a forward leading edge 22, FIG. 2, a rearward trailing edge 24, and right and left sides 26 and 28 with a transverse water passage 30 therebetween which communicates with water pump 16 thereabove. The gear case has a right set of one or more water inlet openings 32 on right side 26 communicating with transverse passage 30 for supplying water to water pump 16, and has a left set of one or more water inlet openings 34 on left side 28 communicating with transverse passage 30 for supplying water to water pump 16. The right side of the gear case has a section 36 tapered inwardly and rearwardly to the one or more water inlet openings 32. The left side of the gear case has a section 38 tapered inwardly and rearwardly to the one or more water inlet openings 34.

Figure 3:
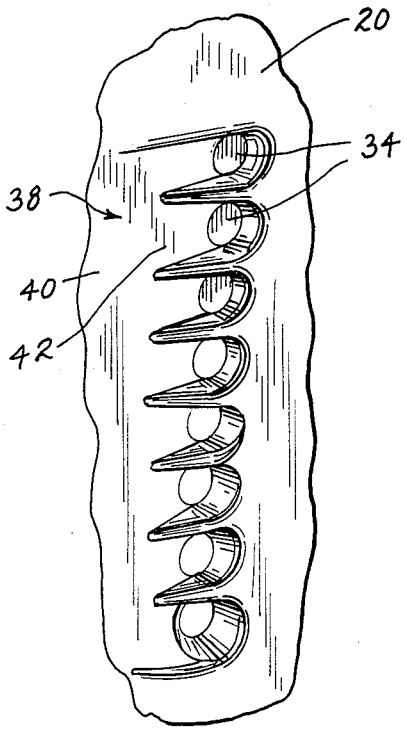
FIG. 3 PRIOR ART
FIG. 3 is an enlarged isolated perspective view of marine gear case water inlets.

FIG. 3 shows one embodiment of water inlet openings 34. These openings are die cast into the gear case during formation of the latter. Tapered section 38 has a forward portion 40 of least taper and a rearward portion 42 of greatest inward taper. Inlet openings 34 are at the rearward end of rearmost tapered portion 42.

Figure 4:
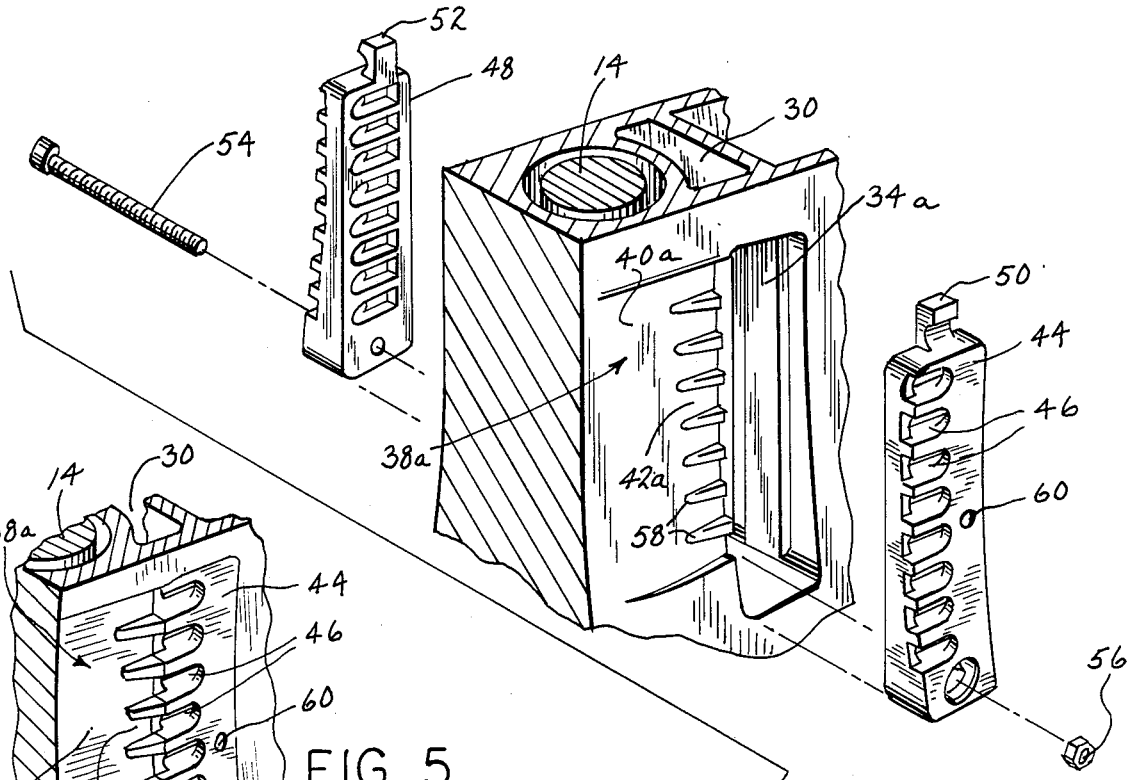
FIG 4 PRIOR ART
FIG. 4 is an exploded perspective view of alternate water inlets.
Figure 5:
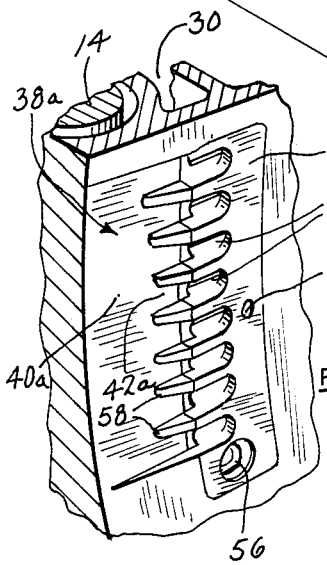
FIG. 5 PRIOR ART
FIG. 5 is an assembly view of a portion of FIG. 4.

FIG. 4 shows another known embodiment of the water inlet openings 34. In this embodiment, the water inlet openings are provided by a slot-like aperture **34*a* in the side of the gear case. A plastic insert 44 is mounted in slot-like aperture 34*a* and has a plurality of channels 46 formed therethrough for guiding water into aperture 34*a* and transverse passage 30. FIG. 4 also shows the insert 48 for mounting in the slot-like aperture in the right side of the gear case. The inserts have upper respective tangs 50 and 52 gripping the inside top edge of the respective aperture and mounted to each other by a screw 54 extending transversely therebetween through passage 30 and secured by nut 56. Tapered section 38*a* has a forward portion 40*a* of least taper and a rearward portion 42*a* of greatest inward taper. Rearward tapered portion 42*a* has a plurality of upstanding protrusions or channel guides 58 forming channels therebetween for guiding water into openings 46 in insert 44 in assembled form, FIG. 5. Aperture 60 in insert 44 is for attachment of a flushing instrument for flushing passage 30** and related components, all as is known.

Description of the Invention

FIGS. 6–8 show water intake means in accordance with the invention, and like reference numerals are used from FIGS. 1–5 where appropriate to facilitate clarity. Right and left water intake plates 62 and 64 cover the respective right and left water inlet openings 32 and 34 and have respective outer forward lips 66 and 68 spaced from the respective water inlet openings 32 and 34 and defining with the gear case respective entrance cavities 70 and 72, FIG. 7, around respective water inlet openings 32 and 34 and trapping additional water and directing same inwardly into respective water inlet openings 32 and 34 for increasing water flow to transverse passage 30 and water pump 16. Plates 62 and 64 extend generally parallel to the direction of water flow past gear case 20 and cover respective water inlet openings 32 and 34 and have respective forward lips 66 and 68 spaced outwardly of respective tapered sections 36 and 38 of the gear case. The forward lip 68 of plate 64 is spaced forwardly of water inlet openings 34 and rearwardly of the forward portion 40 of tapered section 38. Plate 62 is comparable.

Plate 64 has a pair of internally threaded studs 74 and 76 attached thereto. Stud 74 has a shank portion 79 extending through an aperture 80 in plate 64 and has an enlarged head 82 engaging and stopped against the outside of plate 64. Stud 76 is comparable. The other plate 62 has a pair of apertures 84 and 86 through which threaded screws 88 and 90 extend transversely through passage 30 and are received in the respective internally threaded shanks of studs 74 and 76. Screws 88 and 90 extend through water inlet openings 32. The shank portions of studs 74 and 76 extend through water inlet openings 34. Apertures 92 and 94 in plates 62 and 64 are for flushing attachment, as above for aperture 60.

FIGS. 9 and 10 show another embodiment of water intake means in accordance with the invention, and like reference numerals are used from FIGS. 1–5 where appropriate to facilitate clarity. Plates **62*a* and 64*a* are attached to and cover respective inserts 48 and 44 and have respective forward lips 66*a* and 68*a* spaced forwardly of respective inserts 48 and 44 and forwardly and outwardly of the respective water inlet openings. Lips 66*a* and 68*a* are spaced outwardly of the respective tapered sections of the gear case such as 38*a*. Plates 62*a* and 64*a* are attached to respective inserts 48 and 44 by respective rivets 96 and 98, and 100 and 102. Insert 44 has a nut 104 trapped therein behind plate 64*a*. Plates 62*a* has an aperture 106 aligned with aperture 108 in insert 48. Apertures 106 and 108 receive threaded screw 110 extending therethrough and through transverse passage 30 and threaded into trapped nut 104. Threaded screw 110 has an enlarged head 112. Aperture 108 has a diameter less than head 112, and aperture 106 has a diameter greater than head 112, such that head 112 is recessed below plate 62*a*. Aperture 114 in plate 64*a* is aligned with aperture 60 in insert 44 and is for flusing attachment, as noted above, as in aperture 116 in plate 62*a***.

It is recognized that various equivalents, alternatives and modifications are possible within the scope of the appended claims.

We claim:

1. In a marine propulsion ystem having a depending gear case with one or more water inlet openings in the side of said gear case for supplying water to a water pump, water intake means comprising a plate covering said one or more water inlet openings and having a forward opening edge for increasing water pickup, and having a rearward trailing section holding the water captive around said water inlet openings, forcing the water into said water inlet openings and to said water pump, said side of said gear case having a section tapered inwardly to said one or more water inlet openings, said plate having a profile extending parallel to and conforming to the outer profile of said gear case but not to said tapered section of the latter, said plate being substantially flat fore to aft and slightly concave top to bottom and projecting laterally outwardly beyond the outer profile of said gear case by a dimension no greater than the lateral cross sectional thickness of said plate, said forward opening edge being spaced laterally outward from said tapered section of said gear case sufficiently enough to provide substantially increased water flow and water pressure to said water pump during high speed operation in water as compared to the absence of said plate and said forward opening edge, while having little affect on boat speed.

2. In a marine propulsion system having a depending gear case with a forward leading edge and a rearward trailing edge and right and left sides with a transverse water passage therebetween communicating with a water pump, and having a right set of one or more water inlet openings on the right side of said gear case communicating with said transverse passage for supplying water to said water pump, and having a left set of one or more water inlet openings on the left side of said gear case communicating with said transverse passage for supplying water to said water pump, said right and left sides of said gear case having sections tapered inwardly to respective said water inlet openings, left and right water intake plates covering respective said left and right sets of water inlet openings and extending generally parallel to the direction of water flow past said gear case and having respective left and right forward outer lips spaced outwardly of respective said left and right water inlet openings and defining with said gear case tapered sections respective left and right entrance cavities around said respective left and right water inlet openings and trapping additional water and directing same inwardly into said transverse passage for increasing water flow to said water pump, wherein each of said plates has a profile extending parallel to and conforming to the outer profile of said gear case and defining said respective forward outer lips which also extend parallel to and conform to the outer profile of said gear case but not to said tapered sections and defining said entrance cavities of sufficient width to provide substantailly increased water flow and water pressure to said water pump during high speed operation in water as compared to the absence of said plates, while having little affect on boat speed.

3. The invention according to claim 2 comprising means extending through said transverse passage and connecting left and right plates to each other.

4. In a marine propulsion system having a depending gear case with a forward leading edge and a rearward trailing edge and right and left sides with a transverse water passage therebetween communicating with a water pump, and having a right set of one or more water inlet openings on the right side of said gear case communicating with said transverse passage for supplying water to said water pump, and having a left set of one or more water inlet openings on the left side of said gear case communicating with said transverse passage for supplying water to said water pump, left and right water intake plates covering respective said left and right sets of water inlet openings and extending generally parallel to the direction of water flow past said gear case and having respective left and right forward outer lips spaced outwardly of respective said left and right water inlet openings and defining with said gear case respective left and right entrance cavities around said respective left and right water inlet openings and trapping additional water and directing same inwardly into said transverse passage for increasing water flow to said water pump, and comprising means extending through said transverse passage and connecting said left and right plates to each other, wherein one of said left and right plates has one or more internally threaded studs attached thereto, and wherein the other of said left and right plates has one or more apertures therethrough for receiving respective threaded screws extending through said one or more apertures and through said transverse passage and received in respective said internally threaded studs.

5. In a marine propulsion system having a depending gear case with a forward leading edge and a rearward trailing edge and right and left sides with a transverse water passage therebetween communicating with a water pump, and having a right set of one or more water inlet openings on the right side of said gear case communicating with said transverse passage for supplying water to said water pump, and having a left set of one or more water inlet openings on the left side of said gear case communicating with said transverse passage for supplying water to said water pump, left and right water intake plates covering respective said left and right sets of water inlet openings and extending generally parallel to the direction of water flow past said gear case and having respective left and right forward outer lips spaced outwardly of respective said left and right water inlet openings and defining with said gear case respective left and right entrance cavities around said respective left and right water inlet openings and trapping additional water and directing same inwardly into said transverse passage for increasing water flow to said water pump, and comprising means extending through said transverse passage and connecting said left and right plates to each other wherein said left set of one or more water inlet openings comprises a left slot-like aperture in said left side of said gear case, and said right set of one or more water inlet openings comprises a right slot-like aperture in said right side of said gear case, and comprising left and right inserts in respective said left and right slot-like apertures, each insert having a plurality of channels formed therethrough for guiding water into respective said left and right slot-like apertures and said transverse passage, and wherein said left and right plates cover respective said left and right inserts, and said forward lips of said plates are spaced forwardly of respective said inserts, wherein said plates are attached to respective said inserts, and wherein one of said inserts has a trapped nut, and wherein the other of said inserts and its respective said plate have aligned apertures therethrough for receiving a threaded screw extending through said transverse passage and threaded into said trapped nut.

6. The invention according to claim 5 wherein said threaded screw has an enlarged head, and wherein said aperture through said other insert has a diameter less than said head, and said aperture through the respective said plate has a diameter greater than said head.

* * * * *